US011041401B2

(12) United States Patent
Oda

(10) Patent No.: US 11,041,401 B2
(45) Date of Patent: Jun. 22, 2021

(54) INLET GUIDE VANE AND COMPRESSOR

(71) Applicant: MITSUBISHI HEAVY INDUSTRIES COMPRESSOR CORPORATION, Tokyo (JP)

(72) Inventor: Takashi Oda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 109 days.

(21) Appl. No.: 16/475,883

(22) PCT Filed: Feb. 6, 2017

(86) PCT No.: PCT/JP2017/004184
§ 371 (c)(1),
(2) Date: Jul. 3, 2019

(87) PCT Pub. No.: WO2018/142606
PCT Pub. Date: Aug. 9, 2018

(65) Prior Publication Data

US 2019/0376409 A1 Dec. 12, 2019

(51) Int. Cl.
*F04D 29/44* (2006.01)
*F01D 17/16* (2006.01)
*F04D 29/56* (2006.01)

(52) U.S. Cl.
CPC ..... *F01D 17/162* (2013.01); *F04D 29/56* (2013.01); *F05D 2220/32* (2013.01)

(58) Field of Classification Search
CPC .... F04D 29/462; F04D 29/563; F01D 17/162; F01D 17/165; F05D 2250/90
See application file for complete search history.

(56) References Cited

U.S. PATENT DOCUMENTS 5,807,072 A * 9/1998 Payling ..... F01D 17/162 277/422
6,210,106 B1 4/2001 Hawkins
(Continued)

FOREIGN PATENT DOCUMENTS

EP 1793090 A2 6/2007
JP S61215499 A 9/1986
(Continued)

OTHER PUBLICATIONS

International Search Report issued in corresponding International Patent Application No. PCT/JP2017/004184, dated Mar. 21, 2017 (4 pages).
(Continued)

*Primary Examiner* — Ninh H. Nguyen
(74) *Attorney, Agent, or Firm* — Osha Bergman Watanabe & Burton LLP

(57) ABSTRACT

An inlet guide vane includes: a movable vane that has a vane main body and a shaft portion disposed in an end portion of the vane main body; a frame that has an insertion hole into which the shaft portion is to be inserted; a plurality of bearing portions that are arranged inside the insertion hole at an interval in a direction of a central axis of the shaft portion and that support the shaft portion to be rotatable around the central axis with respect to the frame; and a seal portion that is located inside the insertion hole between the plurality of bearing portions in the direction of the central axis and that seals an area between the insertion hole and the shaft portion.

11 Claims, 7 Drawing Sheets

(56) References Cited

U.S. PATENT DOCUMENTS

| | | | | |
|---|---|---|---|---|
| 6,767,183 | B2 * | 7/2004 | Schilling | F01D 17/162 415/160 |
| 7,207,770 | B2 * | 4/2007 | Bruce | F01D 17/162 415/160 |
| 8,038,387 | B2 * | 10/2011 | Houradou | F01D 17/162 415/160 |
| 2007/0128017 | A1 | 6/2007 | Gutknecht et al. | |
| 2012/0263586 | A1 | 10/2012 | Pal et al. | |
| 2015/0030438 | A1 | 1/2015 | Takahashi et al. | |
| 2016/0123347 | A1 | 5/2016 | Johnson et al. | |
| 2016/0290510 | A1 | 10/2016 | Nakamura et al. | |

FOREIGN PATENT DOCUMENTS

| | | | |
|---|---|---|---|
| JP | S64-600 | B | 1/1989 |
| JP | 2007-170378 | A | 7/2007 |
| JP | 2015-021477 | A | 2/2015 |
| JP | 2015-132379 | A | 7/2015 |

OTHER PUBLICATIONS

Written Opinion issued in corresponding International Patent Application No. PCT/JP2017/004184, dated Mar. 21, 2017 (12 pages).

* cited by examiner

INLET GUIDE VANE AND COMPRESSOR

TECHNICAL FIELD

This invention relates to an inlet guide vane and a compressor.

BACKGROUND ART

For example, a centrifugal compressor circulates a fluid inside a rotating impeller, and compresses the fluid in a gaseous state by utilizing a centrifugal force generated when the impeller is rotated. This centrifugal compressor includes a variable type inlet guide vane (IGV) which can adjust a flow rate of the fluid introduced from the outside by changing an angle of an inlet guide vane in order to broaden an operation range of the centrifugal compressor.

The inlet guide vane is disposed in an inlet flow path which introduces the fluid from the outside into a housing of the centrifugal compressor. The inlet guide vane includes a vane case fixed at the inlet flow path, and a plurality of movable vanes which are supported by the vane case and whose opening degree can be adjusted. Each of the movable vanes has a vane main body and a shaft portion integrally formed with the vane main body. In the movable vane, the shaft portion is supported by a shaft hole formed in the vane case so as to be rotatable via a bearing of a bush.

Incidentally, a minute clearance is formed between the bearing and the shaft portion so that the shaft portion of the movable vane is rotatable inside the shaft hole. Through this minute clearance, the fluid leaks outward.

Therefore, for example, Patent Document 1 discloses a configuration where a seal member is provided in order to prevent the fluid from flowing out through the clearance of the shaft portion of the movable vane.

CITATION LIST

Patent Literature

[Patent Document 1] Japanese Unexamined Patent Application, First Publication No. 2015-21477

SUMMARY OF INVENTION

Technical Problem

However, in a case where the fluid inside the flow path has high pressure and a pressure difference from an atmosphere outside the flow path is great, sealing performance in the seal member may become poor due to the pressure difference. Therefore, it is desirable to improve the sealing performance in the shaft portion of the movable vane.

The present invention provides an inlet guide vane and a compressor which can improve sealing performance in a shaft portion of a movable vane.

Solution to Problem

According to a first aspect of the present invention, there is provided an inlet guide vane including a movable vane that has a vane main body and a shaft portion disposed in an end portion of the vane main body, a frame that has an insertion hole into which the shaft portion is to be inserted, a plurality of bearing portions that are arranged inside the insertion hole at an interval in a direction of a central axis of the shaft portion, and that support the shaft portion so as to be rotatable around the central axis with respect to the frame, and a seal portion that is located inside the insertion hole between the plurality of bearing portions in the direction of the central axis, and that is configured to seal between the insertion hole and the shaft portion.

According to this configuration, the seal portion located between the plurality of bearing portions prevents a fluid inside a flow path from leaking outward after passing between an inner peripheral surface of the insertion hole and an outer peripheral surface of the shaft portion. Only the fluid passing through a clearance between the bearing portion and the outer peripheral surface of the shaft portion arrives at the seal portion. Accordingly, the seal portion is less likely to be exposed to the fluid, and is less likely to be affected by the fluid. Therefore, it is possible to continuously achieve high sealing performance by preventing the seal portion from being degraded.

In the inlet guide vane according to a second aspect of the present invention, in the first aspect, the seal portion may include a first seal member and a second seal member which are located at an interval in the direction of the central axis.

According to this configuration, the first seal member and the second seal member allow the seal portion to have a double configuration. Therefore, the sealing performance can be improved.

In the inlet guide vane according to a third aspect of the present invention, in the second aspect, the first seal member and the second seal member may have seal structures which are different from each other.

According to this configuration, the first seal member and the second seal member are caused to have mutually different seal structures, thereby configuring the seal portion having a plurality of sealing characteristics. As a result, higher sealing performance is ensured.

In the inlet guide vane according to a fourth aspect of the present invention, in the third aspect, the first seal member may be located at a position closer to the vane main body than the second seal member, and may have sealing performance higher than that of the second seal member.

According to this configuration, the first seal member having the high sealing performance can effectively prevent the fluid from leaking out of the vane main body side. Furthermore, the second seal member is caused to function as a backup member for sealing the clearance against only the fluid passing through the first seal member. In this manner, even if the sealing performance of the second seal member is suppressed, the sealing performance of the seal portion can be ensured as a whole. As a result, cost for the second seal member can be minimized.

In the inlet guide vane according to a fifth aspect of the present invention, in any one of the second to fourth aspects, at least any one of a hole side recess portion formed on an inner peripheral surface of the insertion hole and recessed outward in a radial direction and a shaft side recess portion formed on an outer peripheral surface of the shaft portion and recessed inward in the radial direction may be formed between the first seal member and the second seal member.

According to this configuration, between the first seal member and the second seal member, a space is formed in which a cross-sectional area of the clearance between the inner peripheral surface of the insertion hole and the outer peripheral surface of the shaft portion is widened by at least one of the hole side recess portion and the shaft side recess portion. Therefore, even in a case where the fluid leaks out of the flow path side, the fluid is reserved in this space, and the fluid can be prevented from leaking outward. In this manner, for example, even if the fluid flows in from the first seal member side and the sealing performance is degraded in the first seal member, the sealing performance as the whole seal portion can be prevented from being degraded.

In any one of the second to fifth aspects, the inlet guide vane according to a sixth aspect of the present invention may further include a sensor that is disposed between the first seal member and the second seal member, and that is configured to detect a fluid entering a clearance between an inner peripheral surface of the insertion hole and an outer peripheral surface of the shaft portion.

According to this configuration, the sensor can detect that the fluid leaks out of the flow path side.

In any one of the second to sixth aspects, the inlet guide vane according to a seventh aspect of the present invention may further include a sealing fluid supply unit that is disposed between the first seal member and the second seal member, and that is configured to supply a sealing fluid from the outside to a clearance between an inner peripheral surface of the insertion hole and an outer peripheral surface of the shaft portion.

According to this configuration, the sealing fluid is fed from the outside to a portion between the first seal member and the second seal member. In this manner, the fluid inside the flow path can be prevented from flowing into the portion between the first seal member and the second seal member.

In the inlet guide vane according to an eighth aspect of the present invention, in any one of the first to seventh aspects, the seal portion may include an elastic ring portion which is disposed outward in a radial direction of the shaft portion, which has an annular shape continuous in a circumferential direction, and which has a groove open toward a side where the vane main body is located with respect to the frame, and a biasing member which is disposed in the groove, and which is configured to cause an inner peripheral surface of the elastic ring portion to be biased inward in the radial direction toward the shaft portion.

According to this configuration, the inner peripheral surface of the elastic ring portion is biased inward in the radial direction by the biasing member. Accordingly, the sealing performance between the seal portion and the shaft portion can be improved. In addition, the groove of the elastic ring portion is open to the side where the vane main body on the flow path side of the fluid is located. Therefore, when the fluid leaks out of the flow path side, the fluid flows into the groove. Since the fluid flows into the groove, the inner peripheral surface of the elastic ring portion is pressed inward in the radial direction. Therefore, the sealing performance between the seal portion and the shaft portion can be improved.

According to a ninth aspect of the present invention, there is provided a compressor including the above-described inlet guide vane.

According to this configuration, the seal portion located between the plurality of bearing portions prevents the fluid inside the flow path from leaking outward after passing between the inner peripheral surface of the insertion hole and the outer peripheral surface of the shaft portion suppress. In this manner, the inlet guide vane is also effectively applicable to the compressor in which flammable gas is used as the fluid.

Advantageous Effects of Invention

According to the present invention, it is possible to improve the sealing performance in the shaft portion of the movable vane.

DESCRIPTION OF EMBODIMENTS

First Embodiment

Figure 1:
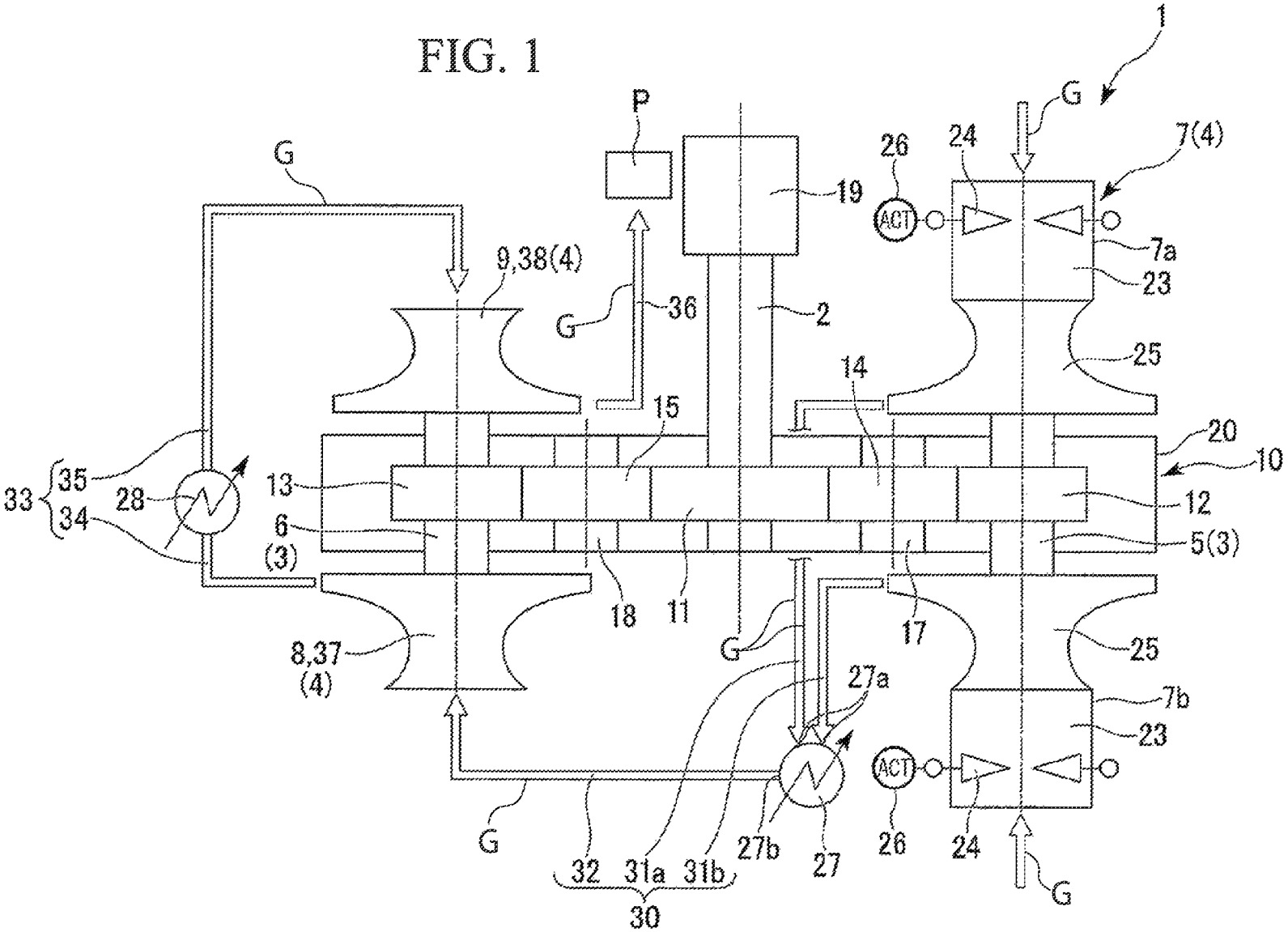
FIG. 1 is a view showing a schematic configuration of a compressor system according to an embodiment of this invention.

Hereinafter, an inlet guide vane and a compressor according to the present invention will be described with reference to the drawings. As shown in FIG. 1, a centrifugal compressor system 1 includes a drive source 19 for generating power, a drive shaft 2, a driven shaft 3, a compression unit 4, and a speed increaser 10.

The drive shaft 2 is driven to be rotatable around a central axis thereof by the drive source 19. For example, as the drive source 19, a steam turbine or a motor can be used.

The driven shaft 3 is driven to be rotatable around the central axis by the power transmitted from the speed increaser 10. The driven shafts 3 are respectively located on both sides across the drive shaft 2. The driven shaft 3 has a first driven shaft 5 and a second driven shaft 6 which respectively extend parallel to the drive shaft 2.

The speed increaser 10 increases rotation speed of the drive shaft 2, and transmits the rotation speed to the first driven shaft 5 and the second driven shaft 6. Inside a casing 20, the speed increaser 10 includes a drive gear 11, a first driven gear 12, a second driven gear 13, a first intermediate gear 14, and a second intermediate gear 15.

The drive gear 11 is disposed in a tip portion of the drive shaft 2 inserted into the casing 20 after penetrating the casing 20, and is rotated integrally with the drive shaft 2. Here, the drive shaft 2 is supported by the casing 20 via a bearing (not shown).

The first driven gear 12 is disposed integrally with the first driven shaft 5 in the intermediate portion in the direction of the central axis of the first driven shaft 5. The second driven gear 13 is disposed integrally with the second driven shaft 6 in the intermediate portion in the direction of the central axis of the second driven shaft 6. The first driven shaft 5 and the second driven shaft 6 are supported by the casing 20 via a bearing (not shown). The first driven gear 12 and the second driven gear 13 are located on both sides across the drive gear 11 at an interval therebetween.

The first intermediate gear 14 is located between the drive gear 11 and the first driven gear 12, and meshes with the drive gear 11 and the first driven gear 12. The second intermediate gear 15 is located between the drive gear 11 and the second driven gear 13 and meshes with the drive gear 11 and the second driven gear 13. The first intermediate gear 14 and the second intermediate gear 15 are so-called idle gears. The first intermediate gear 14 is disposed integrally with a first intermediate shaft 17 rotatably supported by the casing 20 via a bearing (not shown). The second intermediate gear 15 is disposed integrally with a second intermediate shaft 18 rotatably supported by the casing 20 via a bearing (not shown).

In the speed increaser 10 configured in this way, if the drive shaft 2 is rotated by a drive force of the drive source 19, the drive gear 11 is rotated integrally with the drive shaft 2. The rotation of the drive gear 11 is transmitted to the first driven gear 12 and the second driven gear 13 via the first intermediate gear 14 and the second intermediate gear 15. In this manner, the first driven gear 12 and the second driven gear 13 are rotated. In conjunction with the rotation of the first driven gear 12, the first driven shaft 5 is rotated. In conjunction with the rotation of the second driven gear 13, the second driven shaft 6 is rotated. That is, since the drive shaft 2 is driven, the first driven shaft 5 and the second driven shaft 6 are rotated.

The compression unit 4 is driven by power transmitted from the drive shaft 2 to the driven shaft 3 via the speed increaser 10. The compression unit 4 includes two first stage compression units (compressors) 7*a* and 7*b*, a second stage compression unit 8, and a third stage compression unit 9.

The first stage compression units 7*a* and 7*b* are compression units into which a fluid G initially flows in the centrifugal compressor system 1. The first stage compression units 7*a* and 7*b* are respectively disposed in end portions on both sides in the direction of the central axis of the first driven shaft 5. The two first stage compression units 7*a* and 7*b* have the same configuration. The first stage compression units 7*a* and 7*b* according to the present embodiment respectively have a gas inlet 23, an inlet guide vane 24, and an impeller 25.

The gas inlet 23 has a continuous cylindrical shape. The gas inlet 23 internally forms an inlet flow path which introduces the fluid G serving as a compression target from the outside.

The impeller 25 is attached to the first driven shaft 5, and compresses the fluid G supplied from the gas inlet 23.

The inlet guide vane 24 is disposed in the gas inlet 23. The inlet guide vane 24 controls a flow rate of the fluid G passing through the gas inlet 23.

The second stage compression unit 8 is disposed in end portion on a side opposite to a side where the drive source 19 is disposed in the second driven shaft 6. The second stage compression unit 8 has an impeller 37 for compressing the fluid G.

The third stage compression unit 9 is disposed on a side which is the same as the side where the drive source 19 is disposed in the second driven shaft 6. The third stage compression unit 9 has an impeller 38 for compressing the fluid G.

Next, a connection configuration between the compression units will be described.

The two first stage compression units 7*a* and 7*b* are connected to the second stage compression unit 8 via a first stage pipe 30. The first stage pipe 30 is configured to include two first stage compression unit discharge pipes 31*a* and 31*b* and a second stage compression unit suction pipe 32.

A first stage heat exchanger 27 is interposed between the first stage compression unit discharge pipes 31*a* and 31*b* and the second stage compression unit suction pipe 32. The first stage heat exchanger 27 includes two inlet nozzles 27*a* and one outlet nozzle 27*b*. The first stage compression unit discharge pipes 31*a* and 31*b* are respectively connected to the two inlet nozzles 27*a*. The second stage compression unit suction pipe 32 is connected to the outlet nozzle 27*b*. That is, the first stage heat exchanger 27 has a function to cool the double system fluid G discharged from the two first stage compression units 7*a* and 7*b* configuring the first stage compression units 7*a* and 7*b*, and to merge the double system fluid G so as to be the single system fluid G. The fluid G is intermediately cooled by the first stage heat exchanger 27 during a compression process. Accordingly, power needed to drive the centrifugal compressor system 1 is reduced.

The second stage compression unit 8 is connected to the third stage compression unit 9 via the second stage pipe 33. The second stage pipe 33 is configured to include a second stage compression unit discharge pipe 34 and a third stage compression unit suction pipe 35.

A second stage heat exchanger 28 for cooling the fluid G discharged from the second stage compression unit 8 is disposed between the second stage compression unit discharge pipe 34 and the third stage compression unit suction pipe 35. The fluid G is intermediately cooled by the second stage heat exchanger 28 during the compression process. Accordingly, the power needed to drive the centrifugal compressor system 1 is reduced.

The third stage compression unit discharge pipe 36 is connected to the impeller 38 of the third stage compression unit 9. The third stage compression unit discharge pipe 36 is connected to a predetermined plant P serving as a supply destination of the fluid G.

In the centrifugal compressor system 1 as described above, the fluid G to be compressed is introduced from the two gas inlets 23 and 23 configuring the first stage compression units 7*a* and 7*b*, and is compressed in the two first stage compression units 7*a* and 7*b*.

The fluid G compressed in the first stage compression units 7*a* and 7*b* passes through the first stage compression unit discharge pipes 31*a* and 31*b*, and merges after being introduced to the first stage heat exchanger 27. The merged fluid G is introduced to the second stage compression unit 8 through the second stage compression unit suction pipe 32 after the being intermediately cooled by the first stage heat exchanger 27.

The fluid G is compressed in the second stage compression unit 8. Thereafter, the fluid G is fed to the second stage heat exchanger 28 through the second stage compression unit discharge pipe 34. In the second stage heat exchanger 28, the fed fluid G is intermediately cooled. The intermediately cooled fluid G is introduced into the third stage compression unit 9 through the third stage compression unit suction pipe 35.

After being compressed in the third stage compression unit 9, the fluid G is supplied to the predetermined plant P serving as a demand destination of the compressed fluid G through the third stage compression unit discharge pipe 36.

Next, the inlet guide vane 24 will be described in detail.

Figure 2:
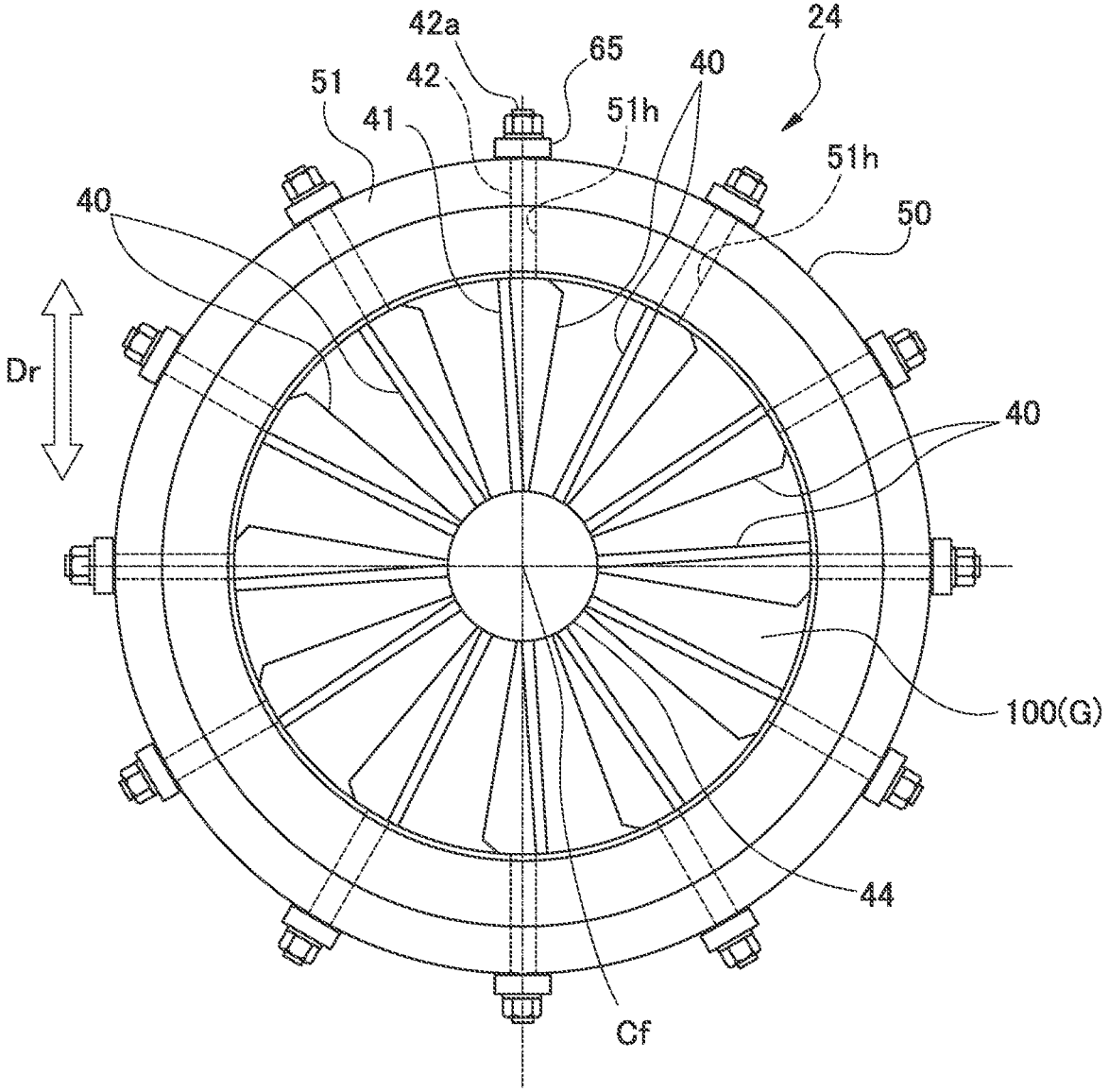
FIG. 2 is a view when an inlet guide vane according to the embodiment of this invention is viewed in a direction of a central axis.
Figure 3:
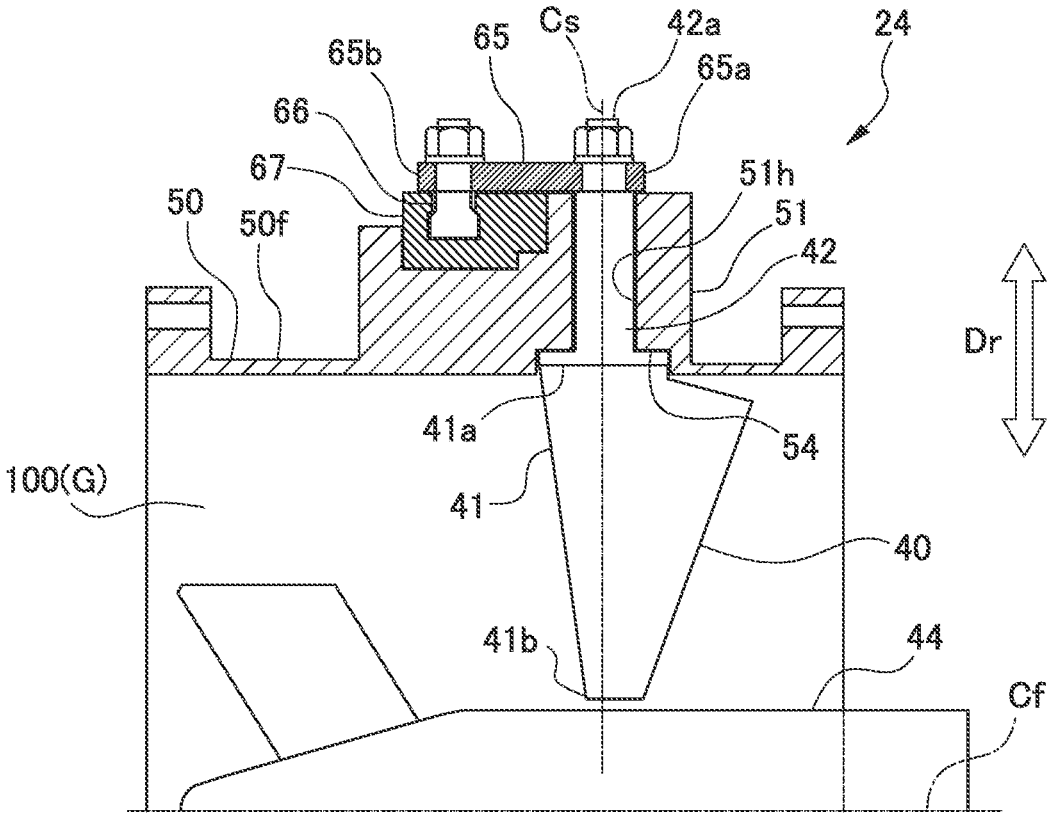
FIG. 3 is a half sectional view taken along the direction of the central axis of the inlet guide vane according to the embodiment of this invention.
Figure 4:
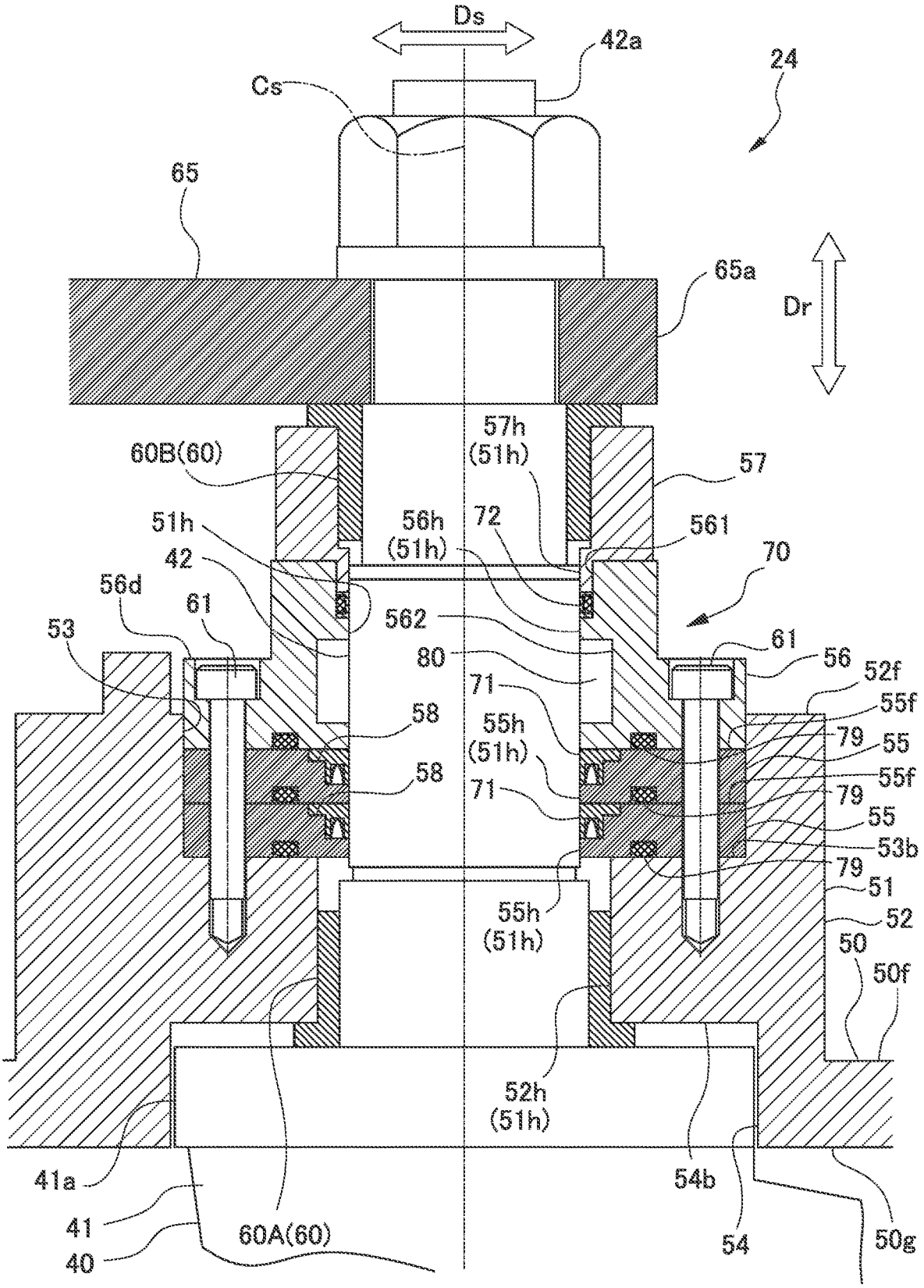
FIG. 4 is a sectional view showing a main portion of an inlet guide vane according to a first embodiment of this invention.

As shown in FIGS. 2 to 4, the inlet guide vane 24 includes a frame 50, a plurality of movable vanes 40, a bearing portion 60, and a seal portion 70.

As shown in FIG. 2, the frame 50 is a vane case having a cylindrical shape. The frame 50 is connected to a cylindrical body configuring the gas inlet 23 (refer to FIG. 1). In this manner, a portion of a flow path 100 of the fluid G flowing inside the gas inlet 23 is formed. An outer peripheral portion of the frame 50 has a vane holder 51. A plurality of insertion holes 51*h* penetrating the frame 50 in a radial direction Dr are formed in the vane holder 51. The insertion holes 51*h* are formed at an interval in the circumferential direction. The movable vane 40 can be attached to the insertion hole 51*h*. Specifically, a shaft portion 42 (to be described later) of the movable vane 40 can be inserted into the insertion hole 51*h*.

The movable vane 40 is rotatably disposed with respect to the frame 50. The plurality of movable vanes 40 are disposed at an interval in the circumferential direction. Each of the movable vanes 40 has a vane main body 41 and the shaft portion 42.

The vane main body 41 is disposed on the inner side (first side) in the radial direction Dr with respect to the frame 50. The vane main body 41 is located by aligning a vane length direction thereof with the radial direction Dr of the frame 50. In a state where the end portion 41*b* located on the inner side in the radial direction Dr leaves a clearance form a center hub 44 disposed in a central portion of the frame 50, the vane main body 41 is rotatable around a central axis Cs of the shaft portion 42.

The shaft portion 42 is disposed integrally with the end portion 41*a* in the vane length direction which is located on the outer side (second side) in the radial direction Dr with respect to the vane main body 41. The shaft portion 42 has a substantially cylindrical shape extending along the direction of the extending central axis Cs of the central axis Cs. In the present embodiment, the direction of the central axis Cs is the radial direction Dr, and is also the vane length direction. In a rotatable state, the shaft portion 42 is inserted into the insertion hole 51*h* formed in the frame 50.

As shown in FIG. 3, a tip portion 42*s* of the shaft portion 42 protrudes outward in the radial direction Dr from the vane holder 51. An end portion 65*a* of a link plate 65 is fixed to the tip portion 42*s* of the shaft portion 42 so that the end portion 65*a* is not rotatable around the central axis Cs. A drive pin 66 is connected to an end portion 65*b* of the link plate 65. The drive pin 66 is disposed on the outer side in the radial direction Dr of the frame 50, and is supported so as to be rotatable around the central axis of the drive pin 66 by a turning ring 67 disposed so as to be capable of turning in the circumferential direction of the frame 50. The turning ring 67 is rotatable around a central axis Cf (refer to FIG. 2) of the frame 50 by an actuator 26 (refer to FIG. 1). If the turning ring 67 is turned around the central axis Cf by the actuator 26, the link plate 65 oscillates around the shaft portion 42 as a center. In this manner, the shaft portion 42 is rotated around the central axis Cs. In this manner, an angle (opening degree) of the vane main body 41 is changed in the flow of the fluid G in the flow path 100 inside the frame 50, and a flow rate of the fluid G passing through the gas inlet 23 is controlled.

As shown in FIG. 4, the bearing portion 60 is disposed inside the insertion hole 51*h* in order to support each of the movable vanes 40. The bearing portion 60 supports the shaft portion 42 so as to be rotatable around the central axis Cs with respect to the insertion hole 51*h* formed in the frame 50. The plurality of bearing portions 60 according to the present embodiment are disposed at an interval in the direction of the central axis Cs of the shaft portion 42. The bearing portion 60 has a cylindrical shape. According to the present embodiment, as the bearing portion 60, two of a first bearing portion 60A and a second bearing portion 60B are disposed therein.

The vane holder 51 supporting the shaft portion 42 so as to be rotatable around the central axis Cs includes a base portion 52, a plurality of seal holding members 55, an intermediate member 56, and a seal pressure member 57.

The base portion 52 is formed so as to protrude outward in the radial direction Dr from an outer peripheral surface 50*f* of the frame 50. The base portion 52 has an outer peripheral recess portion (recess portion) 53 recessed inward in the radial direction Dr on an outer peripheral surface 52*f* of the base portion 52 facing outward in the radial direction Dr of the frame 50. In addition, in the frame 50, a portion where the base portion 52 is formed has an inner peripheral recess portion 54 recessed outward in the radial direction Dr of the frame 50 from an inner peripheral surface 50*g* thereof. The inner peripheral recess portion 54 accommodates a portion of the end portion 41*a* of the vane main body 41 of the movable vane 40.

In addition, the base portion 52 has a base portion through-hole 52*h* extending along the radial direction Dr of the frame 50. The base portion through-hole 52*h* penetrates a bottom surface 54*b* of an inner peripheral recess portion 54 and a bottom surface 53*b* of an outer peripheral recess portion 53. The base portion through-hole 52*h* forms a portion of the insertion hole 51*h*. The first bearing portion 60A is fitted inward toward the outside in the radial direction Dr of the frame 50 with respect to the base portion through-hole 52*h*.

Figure 5:
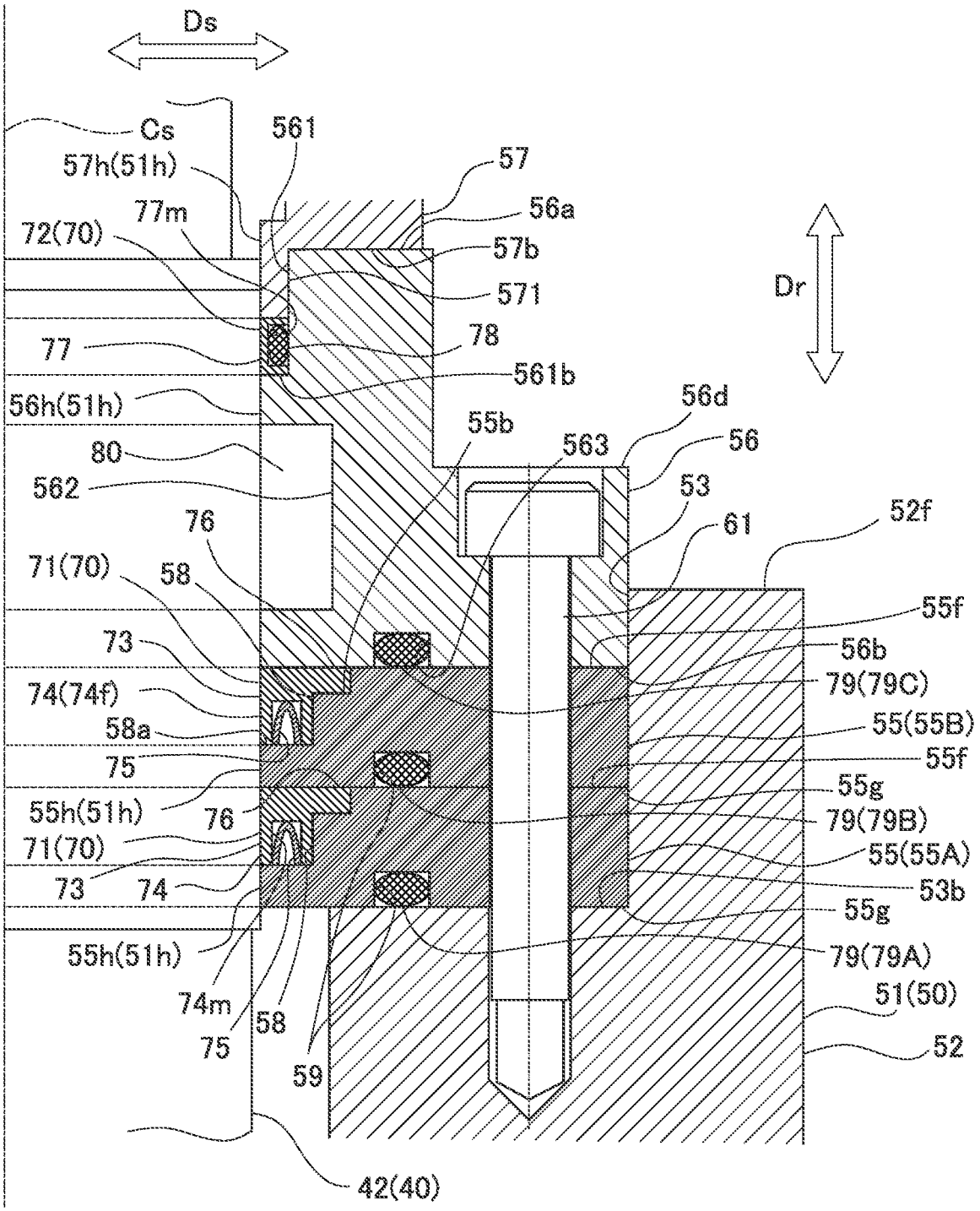
FIG. 5 is an enlarged sectional view showing a portion in FIG. 5.

According to the present embodiment, two seal holding members 55 are provided. The seal holding members 55 are accommodated inside the outer peripheral recess portion 53 of the base portion 52 in a stacked state along the direction of the central axis Cs. As shown in FIG. 5, the seal holding member 55 has a holding member through-hole 55*h* forming a portion of the insertion hole 51*h* in the central portion in the direction of the central axis Cs. In addition, the seal holding member 55 has an accommodation portion 58 which accommodates a first seal member 71 (to be described later).

The accommodation portion 58 is formed on a holding member first surface 55*f* side in the direction of the central axis Cs of the seal holding member 55. The accommodation portion 58 has an annular shape continuous in the circumferential direction on the outer side in a hole diameter direction Ds of the holding member through-hole 55*h*, and is formed to be recessed toward the holding member second surface 55*g* side in the direction of the central axis Cs. Here, the holding member first surface 55*f* is a surface facing outward in the radial direction Dr in the seal holding member 55. In addition, the holding member second surface 55*g* is a surface facing inward in the radial direction Dr in the seal holding member 55. The accommodation portion 58 has an inner peripheral side stepped portion 58*a* facing the inner peripheral side of the holding member through-hole 55*h* and an outer peripheral side stepped portion 58*b* which is recessed toward the holding member second surface 55*g* side and whose dimension is smaller than the inner peripheral side stepped portion 58*a*. The outer peripheral side stepped portion 58*b* is formed to be continuous with the outer peripheral side of the inner peripheral side stepped portion 58*a*.

In addition, on the holding member second surface 55*g* side, the seal holding member 55 has a holding member groove 59 which is continuous in the circumferential direction and which is recessed toward the holding member first surface 55*f* side. The holding member groove 59 is annularly formed on the outer side in the hole diameter direction Ds from the accommodation portion 58 when viewed in the direction of the central axis Cs. The holding member groove 59 accommodates a third seal member 79 (to be described later).

On the intermediate member second surface 56*b* side in the direction of the central axis Cs, the intermediate member 56 integrally has a flange portion 56*d* extending toward the outer peripheral side. In the intermediate member 56, the flange portion 56*d* is inserted into the outer peripheral recess portion 53 of the base portion 52. The intermediate member 56 is stacked on the outer side in the radial direction Dr with respect to the seal holding member 55. Outer peripheral portions of the two seal holding members 55 and the intermediate member 56 are fastened and fixed to each other in the base portion 52 by using a bolt 61.

Here, the intermediate member first surface 56*a* is a surface facing outward in the radial direction Dr in the intermediate member 56. In addition, the intermediate member second surface 56*b* is a surface facing inward in the radial direction Dr in the intermediate member 56.

On the intermediate member first surface 56*a* side in the direction of the central axis Cs, the intermediate member 56 has an intermediate recess portion 561 recessed toward the intermediate member second surface 56*b* in the direction of the central axis Cs. In addition, the intermediate member 56 has an intermediate member through-hole 56*h* penetrating the intermediate recess portion 561 and the intermediate member second surface 56*b* in the central portion in the hole diameter direction Ds. The intermediate member through-hole 56*h* forms a portion of the insertion hole 51*h*.

The intermediate member 56 has a hole side recess portion 562 recessed outward in the hole diameter direction Ds of the intermediate member through-hole 56*h*. The hole side recess portion 562 is continuous in the circumferential direction around the central axis Cs in the intermediate portion in the direction of the central axis Cs of the intermediate member through-hole 56*h*.

The hole side recess portion 562 may not be formed in the intermediate member 56, and a shaft side recess portion recessed inward in the hole diameter direction Ds may be formed on the outer peripheral surface 42*f* of the shaft portion 42. Therefore, at least one of the hole side recess portion 562 and the shaft side recess portion may be formed so as to form a space for widening a space between the first seal member 71 and the second seal member 72.

In addition, on the intermediate member second surface 56*b* side, the intermediate member 56 has an intermediate member groove 563 which is continuous in the circumferential direction and which is recessed toward the intermediate member first surface 56*a* side. The intermediate member groove 563 is annularly formed on the outer side in the hole diameter direction Ds from the accommodation portion 58 formed in the seal holding member 55 when viewed in the direction of the central axis Cs. The intermediate member groove 563 accommodates a third seal member 79 (to be described later).

The seal pressure member 57 is located on the outer side in the radial direction Dr with respect to the intermediate member 56. The central portion of seal pressure member 57 has a through-hole 57*h* forming a portion of the insertion hole 51*h*. The second bearing portion 60B is fitted inward from the outer side in the radial direction Dr of the frame 50 with respect to the seal pressure member 57. On the second surface 57*b* side in the direction of the central axis Cs, the seal pressure member 57 has an insertion cylinder portion 571 which is inserted into the intermediate recess portion 561 of the intermediate member 56. The second seal member 72 located inside the intermediate recess portion 561 is interposed between the insertion cylinder portion 571 of the seal pressure member 57 and the bottom surface 561*b* of the intermediate recess portion 561.

The seal portion 70 is located inside the insertion hole 51*h* of the above-described vane holder 51. The seal portion 70 is located between the plurality of bearing portions 60 in the direction of the central axis Cs. The seal portion 70 seals a portion between the insertion hole 51*h* and the shaft portion 42, thereby preventing the fluid G from flowing outward from the inner side of the frame 50, that is, flowing out of the flow path 100. The seal portion 70 according to the present embodiment is disposed between the first bearing portion 60A and the second bearing portion 60B. The seal portion 70 has the first seal member 71 and the second seal member 72 which are arranged at an interval in the direction of the central axis Cs.

The first seal member 71 is accommodated in the accommodation portion 58 of the seal holding member 55. The first seal members 71 are respectively accommodated in the two seal holding members 55. That is, the first seal members 71 are disposed in a double structure in the direction of the central axis Cs.

The first seal member 71 has an annular seal portion main body 73 to be accommodated in the inner peripheral side stepped portion 58*a* of the accommodation portion 58 and a lip portion 76 extending outward in the hole diameter direction Ds from the seal portion main body 73.

The seal portion main body 73 is continuous in the circumferential direction on the outer side in the hole diameter direction Ds of the shaft portion 42. The seal portion main body 73 includes an elastic ring portion 74 and a biasing member 75. The lip portion 76 is accommodated in the outer peripheral side stepped portion 58*b*.

The elastic ring portion 74 has an annular shape continuous in the circumferential direction on the outer side in the hole diameter direction Ds of the shaft portion 42. The elastic ring portion 74 is made of an elastic material such as a rubber-based material. The elastic ring portion 74 has a ring groove 74*m* which is open inward in the radial direction Dr of the frame 50.

The biasing member 75 is formed from a leaf spring material curved in an inverted U-shape which is open inward in the radial direction Dr. The biasing member 75 is accommodated inside the ring groove 74*m* of the elastic ring portion 74. The biasing member 75 causes the inner peripheral surface 74*f* of the elastic ring portion 74 to be biased inward in the hole diameter direction Ds of the insertion hole 51*h*.

The second seal member 72 is accommodated in the intermediate recess portion 561 of the intermediate member 56. The second seal member 72 is located at a position farther from the vane main body 41 than the first seal member 71. That is, the two first seal members 71 are arranged at a position closer to the vane main body 41 than the second seal member 72 in the insertion hole 51*h*. The second seal member 72 includes a seal cap 77 and a seal ring 78.

The seal cap 77 has a cap groove 77*m* which has an annular shape and which is open outward in the hole diameter direction Ds of the insertion hole 51*h*. The seal ring 78 is made of a rubber-based material. The seal ring 78 is disposed inside the cap groove 77*m*. The seal ring 78 causes the seal cap 77 to be biased inward in the hole diameter direction Ds of the insertion hole 51*h*.

In this way, the first seal member 71 and the second seal member 72 have mutually different seal structures. In addition, the first seal member 71 located inward in the radial direction Dr from the second seal member 72 has sealing performance which is higher than that of the second seal member 72.

The first seal member 71 and the second seal member 72 are not limited to an example where both of these have the mutually different seal structures. Both of these may have the same seal structure.

The seal portion 70 further includes the third seal member 79. The third seal member 79 is an O-ring made of an annular rubber-based material. The third seal members 79 are respectively accommodated in the holding member groove 59 and the intermediate member groove 563. The third seal member 79A accommodated in the holding member groove 59 seals a portion between the seal holding member 55A and the bottom surface 53*b* of the outer peripheral recess portion 53 of the base portion 52 facing the seal holding member 55A. The third seal member 79C accommodated in the intermediate member groove 563 seals a portion between the intermediate member 56 and the seal holding member 55B.

In addition, the seal portion 70 includes a seal space 80 between the first seal member 71 and the second seal member 72. The seal space 80 is formed between the first seal member 71 and the second seal member 72. The seal space 80 is formed so that a cross-sectional area of a clearance between the insertion hole 51*h* and the shaft portion 42 is widened by the hole side recess portion 562.

According to the inlet guide vane 24 and the centrifugal compressor system 1 of the above-described embodiment, the seal portion 70 located between the plurality of first bearing portions 60A and the second bearing portion 60B prevent the fluid G inside the flow path 100 from leaking outward after passing between the insertion hole 51*h* the shaft portion 42. Only the fluid passing through the clearance between the first bearing portion 60A and the second bearing portion 60B and the outer peripheral surface of the shaft portion 42 arrives at the seal portion 70. Therefore, the seal portion 70 is less likely to be exposed to the fluid, and is less likely to be affected by the fluid, compared to a case where the seal portion 70 is directly exposed to the fluid. Therefore, it is possible to continuously achieve the high sealing performance by preventing the seal portion 70 from being degraded.

In addition, the first bearing portion 60A and the second bearing portion 60B which have the cylindrical shape are disposed on both sides in the direction of the central axis Cs of the shaft portion 42 with respect to the seal portion 70. Compared to a case of disposing a ball bearing, for example, instead of the first bearing portion 60A and the second bearing portion 60B, the clearance becomes smaller between the outer peripheral surface 42*f* of the shaft portion 42 and the first bearing portion 60A and the second bearing portion 60B. Therefore, only the fluid G passing through the clearance between the first bearing portion 60A and the outer peripheral surface 42*f* of the shaft portion 42 arrives at the first seal member 71. Accordingly, it is possible to effectively achieve the sealing performance in the first seal member 71. In this way, it is possible to improve the sealing performance in the shaft portion 42 of the movable vane 40.

In addition, the sealing performance can be improved by allowing the seal portion 70 to have a double configuration of the first seal member 71 and the second seal member 72. Furthermore, the first seal members 71 are disposed in a double structure. Therefore, the sealing performance can be further improved.

In addition, the first seal member 71 and the second seal member 72 are caused to have the mutually different seal structures, thereby configuring the seal portion 70 having a plurality of sealing characteristics. As a result, the higher sealing performance is ensured.

In addition, the first seal member 71 has the sealing performance higher than that of the second seal member 72 located outward in the radial direction Dr which is away from the vane main body 41 with respect to the first seal member 71. According to this configuration, the first seal member 71 can effectively prevent the fluid G from leaking out of the flow path 100 side. In addition, the second seal member 72 can function as a backup member for sealing the clearance against only the fluid G passing through the first seal member 71. Therefore, even if the sealing performance of the second seal member 72 is suppressed, the sealing performance of the seal portion 70 can be ensured as a whole. As a result, cost for the second seal member 72 can be minimized.

In addition, in the first seal member 71, the biasing member 75 causes the inner peripheral surface 74*f* of the elastic ring portion 74 to be biased inward in the hole diameter direction Ds. In this manner, it is possible to improve the sealing performance between the first seal member 71 and the shaft portion 42.

In addition, the ring groove 74*m* of the elastic ring portion 74 is open inward in the radial direction Dr on the flow path 100 side of the fluid G Accordingly, when the fluid G leaks out of the flow path 100 side, the fluid G flows into the ring groove 74*m*. Since the fluid G flows into the ring groove 74*m*, the inner peripheral surface 74*f* of the elastic ring portion 74 is pressed inward in the hole diameter direction Ds. Therefore, it is possible to improve the sealing performance between the first seal member 71 and the shaft portion 42.

In addition, the frame 50 includes the plurality of seal holding members 55 stacked along the direction of the central axis Cs. The first seal member 71 can be accommodated in the accommodation portion 58 from the holding member first surface 55*f* side of the respective seal holding members 55. In this manner, assembling work can be more easily carried out, compared to a case where the first seal member 71 is assembled outward from the inside in the hole diameter direction Ds of the holding member through-hole 55*h*.

In addition, in the first seal member 71, the lip portion 76 extending outward in the hole diameter direction Ds from the seal portion main body 73 is interposed between the seal holding member 55 having the first seal member 71 incorporated therein and other members. Accordingly, the first seal member 71 is prevented from interfering with the shaft portion 42. In addition, the fluid G is prevented from leaking out of the clearance between the seal holding member 55 and other members.

In addition, the third seal member 79 located on the outer side in the hole diameter direction Ds of the first seal member 71 can more reliably prevent the fluid G from leaking out of the clearance between the plurality of stacked seal holding members 55 and other members.

In addition, the seal space 80 is formed between the first seal member 71 and the second seal member 72 by the hole side recess portion 562. When the fluid G leaks out of the flow path 100 side, the fluid G flows into the seal space 80. In this manner, the fluid G can be prevented from leaking outward.

Second Embodiment

Next, referring to FIG. 6, an inlet guide vane according to a second embodiment will be described. In the second embodiment, the same reference numerals will be given to the configuration elements which are the same as those according to the first embodiment, and detailed description thereof will be omitted. The inlet guide vane according to the second embodiment is different from that according to the first embodiment in that the inlet guide vane has a different configuration of the seal portion.

Figure 6:
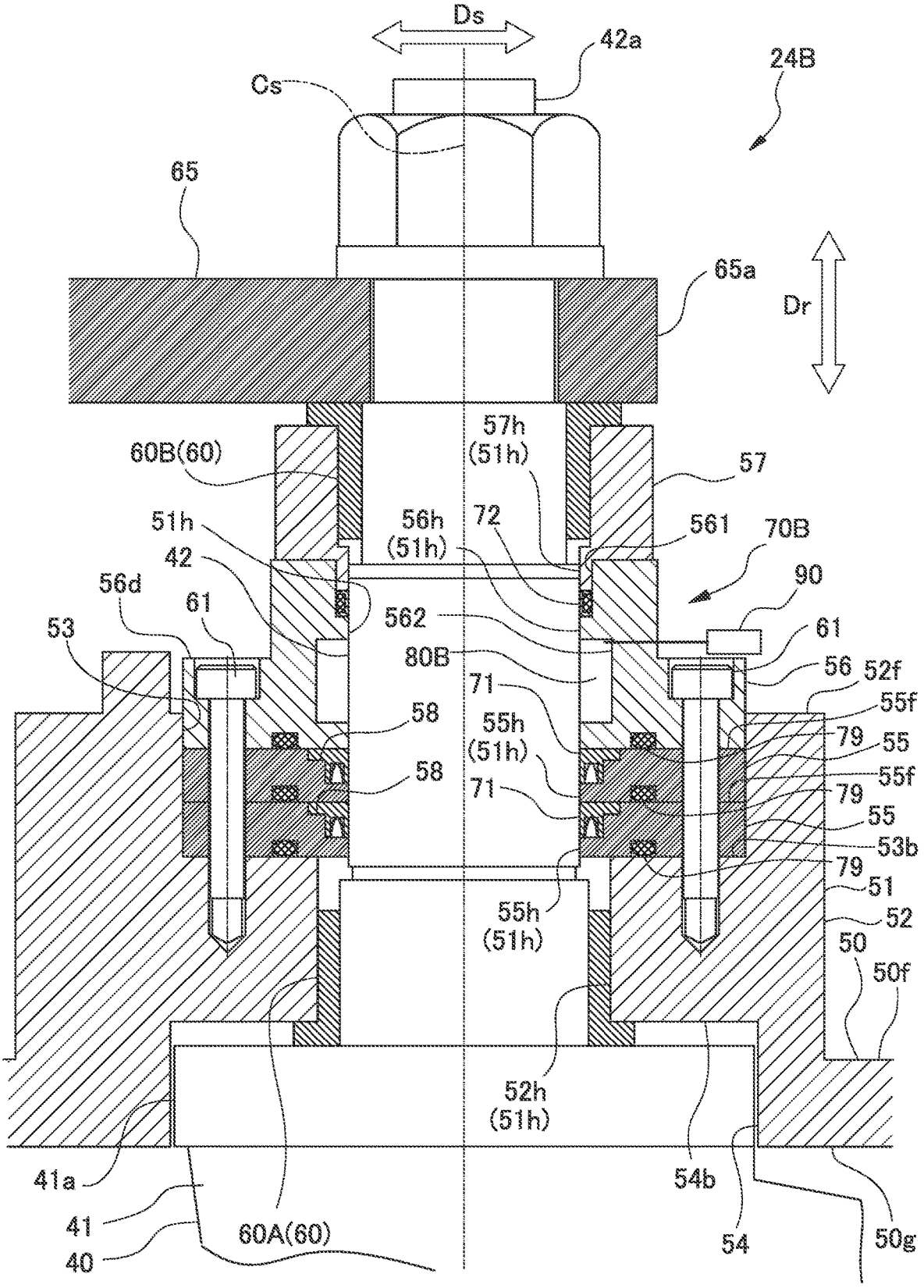
FIG. 6 is a sectional view showing a main portion of an inlet guide vane according to a second embodiment of this invention.

That is, as shown in FIG. 6, similar to the inlet guide vane 24 according to the first embodiment, an inlet guide vane 24B according to the second embodiment includes the frame 50 and the plurality of movable vanes 40.

The outer peripheral portion of the frame 50 has the vane holder 51. The vane holder 51 has the insertion holes 51*h* formed so as to extend along the radial direction Dr of the frame 50 at a plurality of locations formed at an interval in the circumferential direction.

The movable vane 40 is supported by the first bearing portion 60A and the second bearing portion 60B which are disposed in the insertion hole 51*h* so that the shaft portion 42 is rotatable around the central axis Cs.

A seal portion 70B is disposed between the first bearing portion 60A and the second bearing portion 60B. A seal space 80B is formed between the first seal member 71 and the second seal member 72 of the seal portion 70B by a hole side recess portion 562 formed in the intermediate member 56.

The seal portion 70B includes a sensor 90 which detects that the fluid G inside the flow path 100 enters the seal space 80B. The sensor 90 detects that the fluid G enters the seal space 80B by detecting the pressure, the temperature, or the substances configuring the fluid G inside the seal space 80B.

According to the configuration as described above, similar to the first embodiment, the sealing performance in the shaft portion 42 of the movable vane 40 can be improved. Furthermore, the sensor 90 can detect that the fluid G leaks to the clearance between the insertion hole 51*h* and the shaft portion 42 from the inside of the flow path 100. In this manner, in a case where the sensor 90 detects the leakage of the fluid G, maintenance work for the seal portion 70B can be carried out at a proper timing by stopping the operation of the centrifugal compressor system 1.

Third Embodiment

Next, referring to FIG. 7, an inlet guide vane according to a third embodiment will be described. In the third embodiment, the same reference numerals will be given to the configuration elements which are the same as those according to the first and second embodiments, and detailed description thereof will be omitted. The inlet guide vane according to the third embodiment is different from those according to the first and second embodiments in that the inlet guide vane has a different configuration of the seal portion.

Figure 7:
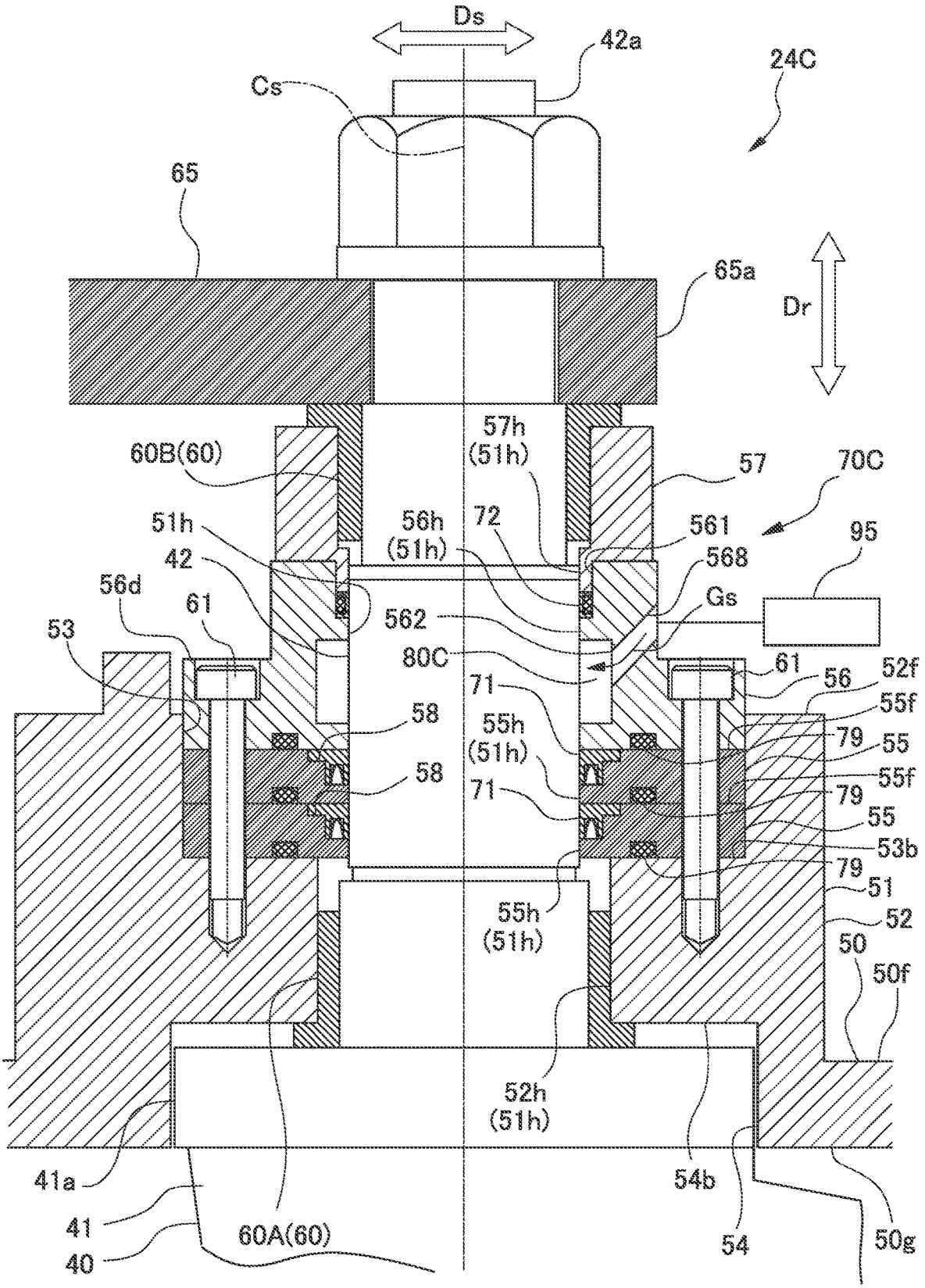
FIG. 7 is a sectional view showing a main portion of an inlet guide vane according to a third embodiment of this invention.

That is, as shown in FIG. 7, similar to the inlet guide vane 24 according to the first embodiment, an inlet guide vane 24C according to the third embodiment includes the frame 50 and the plurality of movable vanes 40.

The outer peripheral portion of the frame 50 has the vane holder 51. The vane holder 51 has the insertion holes 51*h* formed so as to extend along the radial direction Dr of the frame 50 at a plurality of locations formed at an interval in the circumferential direction.

The movable vane 40 is supported by the first bearing portion 60A and the second bearing portion 60B which are disposed in the insertion hole 51*h* so that the shaft portion 42 is rotatable around the central axis Cs.

A seal portion 70C is disposed between the first bearing portion 60A and the second bearing portion 60B. A seal space 80C is formed between the first seal member 71 and the second seal member 72 of the seal portion 70C by the hole side recess portion 562 formed in the intermediate member 56.

The intermediate member 56 has a communication hole 568 which allows the outside and the hole side recess portion 562 to communicate with each other. A sealing fluid supply unit 95 is connected to the communication hole 568. The sealing fluid supply unit 95 supplies a sealing fluid Gs from the outside to the seal space 80C of the clearance between the insertion hole 51*h* and the shaft portion 42.

The sealing fluid supply unit 95 pressurizes the seal space 80C by supplying the sealing fluid Gs. It is preferable that the pressure inside the pressurized seal space 80C is lower than the pressure inside the flow path 100 and higher than the pressure (atmospheric pressure) outside the frame 50.

According to the configuration as described above, similar to the above-described first embodiment, the sealing performance in the shaft portion 42 of the movable vane 40 can be improved. Furthermore, the sealing fluid Gs is fed from the outside into the seal space 80C between the first seal member 71 and the second seal member 72 so as to pressurize the inside of the seal space 80C. In this manner, a pressure difference decreases between the pressure of the fluid G inside the flow path 100 and the pressure inside the seal space 80C. As a result, it is possible to prevent the fluid G inside the flow path 100 from flowing into the portion between the first seal member 71 and the second seal member 72. Accordingly, the sealing performance can be further improved. In this manner, it is possible to prevent the first seal member 71 from being damaged.

Hitherto, the embodiments according to the present invention have been described in detail with reference to the drawings. However, the respective configurations and combinations thereof in the respective embodiments are merely examples. Additions, omissions, substitutions, and modifications of the configurations are available within the scope not departing from the gist of the present invention. In addition, the present invention is not limited by the embodiments, and is limited only by the appended claims.

For example, the inlet guide vanes 24, 24B, and 24C which are shown in the above-described embodiments are applicable not only to a geared compressor configuring the centrifugal compressor system 1 but also to an axial flow compressor or a gas turbine.

INDUSTRIAL APPLICABILITY

According to the inlet guide vane and the compressor which are described above, it is possible to improve the sealing performance in the shaft portion of the movable vane of the inlet guide vane.

REFERENCE SIGNS LIST

1: centrifugal compressor system
2: drive shaft
3: driven shaft
4: compression unit
5: first driven shaft
6: second driven shaft
7*a*, 7*b*: first stage compression unit (compressor)
8: second stage compression unit
9: third stage compression unit
10: speed increaser
11: drive gear
12: first driven gear

13: second driven gear
14: first intermediate gear
15: second intermediate gear
17: first intermediate shaft
18: second intermediate shaft
19: drive source
20: casing
23: gas inlet
24, 24B, 24C: inlet guide vane
25, 37, 38: impeller
26: actuator
27: first stage heat exchanger
27*a*: inlet nozzle
27*b*: outlet nozzle
28: second stage heat exchanger
30: first stage pipe
31*a*, 31*b*: first stage compression unit discharge pipe
32: second stage compression unit suction pipe
33: second stage pipe
34: second stage compression unit discharge pipe
35: third stage compression unit suction pipe
36: third stage compression unit discharge pipe
40: movable vane
41: vane main body
41*a*, 41*b*: end portion
42: shaft portion
42*f*: outer peripheral surface
42*s*: tip portion
44: center hub
50: frame
50*f*: outer peripheral surface
50*g*: inner peripheral surface
51: vane holder
51*f*: inner peripheral surface
51*h*: insertion hole
52: base portion
52*f*: outer peripheral surface
52*h*: base portion through-hole
53: outer peripheral recess portion
53*b*: bottom surface
54: inner peripheral recess portion
54*b*: bottom surface
55, 55A, 55B: seal holding member
55*f*: holding member first surface
55*g*: holding member second surface
55*h*: holding member through-hole
56: intermediate member
56*a*: intermediate member first surface
56*b*: intermediate member second surface
56*d*: flange portion
56*h*: intermediate member through-hole
561: intermediate recess portion
561*b*: bottom surface
562: hole side recess portion
563: intermediate member groove
568: communication hole
57: seal pressure member
57*b*: second surface
57*h*: through-hole
571: insertion cylinder portion
58: accommodation portion
58*a*: inner peripheral side stepped portion
58*b*: outer peripheral side stepped portion
59: holding member groove
60: bearing portion
60A: first bearing portion
60B: second bearing portion
61: bolt
65: link plate
65*a*, 65*b*: end portion
66: drive pin
67: turning ring
70, 70B, 70C: seal portion
71: first seal member
72: second seal member
73: seal portion main body
74: elastic ring portion
74*f*: inner peripheral surface
74*m*: ring groove
75: biasing member
76: lip portion
77: seal cap
77*m*: cap groove
78: seal ring
79, 79A, 79B, 79C: third seal member
80, 80B, 80C: seal space
90: sensor
95: sealing fluid supply unit
100: flow path
Cs: central axis
Dr: radial direction
Ds: hole diameter direction
G: fluid
Gs: sealing fluid
P: plant

What is claimed is:

1. An inlet guide vane comprising:

a movable vane that has a vane main body and a shaft portion disposed in an end portion of the vane main body;

a frame that has an insertion hole into which the shaft portion is to be inserted;

a plurality of bearing portions that are arranged inside the insertion hole at an interval in a direction of a central axis of the shaft portion, and that support the shaft portion so as to be rotatable around the central axis with respect to the frame; and a seal portion that is located inside the insertion hole between the plurality of bearing portions in the direction of the central axis, and that is configured to seal between the insertion hole and the shaft portion, wherein the seal portion includes a first seal member and a second seal member which are located at an interval in the direction of the central axis, and wherein the first seal member and the second seal member have seal structures which are different from each other.

2. The inlet guide vane according to claim 1, wherein the first seal member is located at a position closer to the vane main body than the second seal member, and has sealing performance higher than that of the second seal member.

3. The inlet guide vane according to claim 2, wherein at least any one of a hole side recess portion formed on an inner peripheral surface of the insertion hole and recessed outward in a radial direction and a shaft side recess portion formed on an outer peripheral surface of the shaft portion and recessed inward in the radial direction is formed between the first seal member and the second seal member.

4. The inlet guide vane according to claim 3, further comprising:

a sensor that is disposed between the first seal member and the second seal member, and that is configured to detect a fluid entering a clearance between an inner peripheral surface of the insertion hole and an outer peripheral surface of the shaft portion.

5. The inlet guide vane according to claim 2, further comprising:

a sensor that is disposed between the first seal member and the second seal member, and that is configured to detect a fluid entering a clearance between an inner peripheral surface of the insertion hole and an outer peripheral surface of the shaft portion.

6. The inlet guide vane according to claim 1, wherein at least any one of a hole side recess portion formed on an inner peripheral surface of the insertion hole and recessed outward in a radial direction and a shaft side recess portion formed on an outer peripheral surface of the shaft portion and recessed inward in the radial direction is formed between the first seal member and the second seal member.

7. The inlet guide vane according to claim 6, further comprising:

a sensor that is disposed between the first seal member and the second seal member, and that is configured to detect a fluid entering a clearance between an inner peripheral surface of the insertion hole and an outer peripheral surface of the shaft portion.

8. The inlet guide vane according to claim 1, further comprising:

a sensor that is disposed between the first seal member and the second seal member, and that is configured to detect a fluid entering a clearance between an inner peripheral surface of the insertion hole and an outer peripheral surface of the shaft portion.

9. The inlet guide vane according to claim 1, further comprising:

a sealing fluid supply unit that is disposed between the first seal member and the second seal member, and that is configured to supply a sealing fluid from the outside to a clearance between an inner peripheral surface of the insertion hole and an outer peripheral surface of the shaft portion.

10. The inlet guide vane according to claim 1, wherein the seal portion includes an elastic ring portion which is disposed outward in a radial direction of the shaft portion, which has an annular shape continuous in a circumferential direction, and which has a groove open toward a side where the vane main body is located with respect to the frame, and a biasing member which is disposed in the groove, and which is configured to cause an inner peripheral surface of the elastic ring portion to be biased inward in the radial direction toward the shaft portion.

11. A compressor comprising:

the inlet guide vane according to claim 1.

* * * * *